United States Patent [19]
Braine
[11] 4,365,455
[45] Dec. 28, 1982

[54] METHOD OF BUILDING CONSTRUCTION

[76] Inventor: William G. Braine, 7 Brodie St., Christchurch, New Zealand

[21] Appl. No.: 176,559

[22] Filed: Aug. 8, 1980

Related U.S. Application Data

[63] Continuation of Ser. No. 908,566, May 22, 1978, abandoned.

[30] Foreign Application Priority Data

May 23, 1977 [NZ] New Zealand ..... 184184

[51] Int. Cl.[3] ..... E04B 1/34; E04C 3/00

[52] U.S. Cl. ..... 52/741; 52/2; 264/32; 264/34; 264/35

[58] Field of Search ..... 52/2, 741; 264/32, 31, 264/34, 35

[56] References Cited

U.S. PATENT DOCUMENTS

| | | | |
|---|---|---|---|
| 2,270,229 | 1/1942 | Neff | 264/32 |
| 2,335,300 | 11/1943 | Neff | 52/2 |
| 2,892,239 | 6/1959 | Neff | 52/2 |
| 2,948,286 | 8/1960 | Turner | 52/2 |
| 3,118,010 | 1/1964 | Harrington | 52/2 |
| 3,225,413 | 12/1965 | Bird | 52/2 |
| 3,277,219 | 10/1966 | Turner | 52/2 |
| 3,462,521 | 8/1969 | Bini | 52/2 |
| 3,619,432 | 11/1971 | Himmel | 52/2 |
| 3,751,862 | 8/1973 | Linecker | 52/2 |
| 3,927,497 | 12/1975 | Kersavage | 52/80 |
| 3,932,969 | 1/1976 | Matras | 264/32 |
| 3,984,950 | 10/1976 | Hillebrand | 52/80 |
| 4,041,671 | 8/1977 | Nicholson | 52/2 |
| 4,077,177 | 3/1978 | Boothroyd | 52/2 |

FOREIGN PATENT DOCUMENTS

| | | | |
|---|---|---|---|
| 2334793 | 7/1977 | France | 52/2 |
| 2347497 | 11/1977 | France | 52/2 |
| 2716325 | 10/1977 | German Democratic Rep. | 52/2 |
| 776077 | 6/1957 | United Kingdom | 52/224 |
| 1037628 | 7/1966 | United Kingdom | 52/2 |

OTHER PUBLICATIONS

Engineering News Record, 10/21/43, p. 103.

*Primary Examiner*—Price C. Faw, Jr.
*Assistant Examiner*—Henry E. Raduazo
*Attorney, Agent, or Firm*—Abelman, Frayne & Rezac

[57] ABSTRACT

A method of constructing a construction shell, the method comprising the steps of:

forming a sheet of thin flexible material into a shape complementary to the shape of a constructional shell to be formed; erecting and supporting the sheet material in the desired shape and configuration of shell required; strengthening and stiffening the sheet of thin material progressively to form a strengthened shell former of the desired shape; coating the strengthened and stiffened shell former with at least one layer of an outer or inner structural coating material so as to form a constructional shell of desired shape which can be used for a variety of different building constructions.

The method of constructing an outer shell for a building according to the invention as hereinbefore described can additionally comprise the following steps:

constructing a building foundation, foundation slab or wall of a desired shape; fixing peripheral edge parts of the sheet of material to the building foundation and erecting and supporting the sheet of material in a double curvature shape so that the sheet of thin material can be progressively stiffened and strengthened to form a stiffened shell former of the desired shape on which or inside of which a layer of structural coating material can be applied.

33 Claims, 10 Drawing Figures

FIG. 9
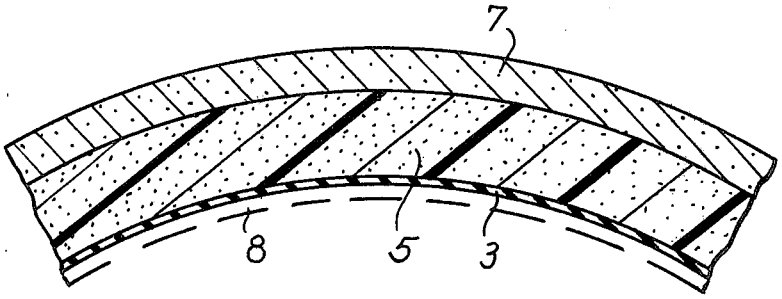
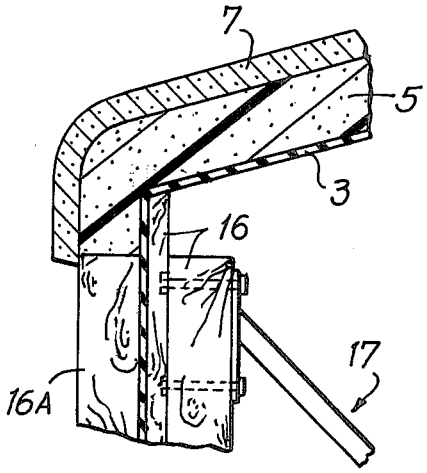
FIG. 10

METHOD OF BUILDING CONSTRUCTION

This is a continuation of application Ser. No. 908,566 filed May 22, 1978 and now abandoned.

The invention relates to building constructions and more particularly to thin or relatively thin shell constructions as opposed to the more conventional framed, panel, block, brick and like constructions.

It is well established that thin shell constructions can be particularly efficient in use of materials and in the past various constructions of building shells have been proposed and used; however most such known shell building constructions suffer from various disadvantages and some of these disadvantages are set out below.

One such known method of building construction has utilised a closely spaced double curvature framework which is used to support hand laid layers of wire mesh reinforcement upon which a concrete material is hand plastered so as to produce a dense thin water tight shell. A disadvantage of this construction to form a ferrocement shell is the high labour cost of hand placing the temporary framework, reinforcement mesh and plaster. Another disadvantage is that such a building shell is only a single layer shell which lacks effective thermal insulation.

Another known construction is the complete plastics shell but this construction has the disadvantage of high material cost, particularly for a large shell, plus fireproof and durability problems when compared with a concrete shell.

Another known construction is the concrete shell placed directly over an inflated preshaped, reinforced, balloon former. This construction has the disadvantage that the shape must be strictly a dome shape with any openings cut through the concrete shell afterwards. The cost of the fabricated dome shape former is high, particularly when it must be constructed to have minimal movement when the concrete is being placed thereon and whilst the concrete is developing its structural strength. Another disadvantage is a tendency for the concrete to slump off the sides of the balloon framework, and the poor quality concrete produced due to movement.

Some of the above disadvantages referred to above also apply to the Bini type shell, a recently developed method of constructing a concrete shell directly over a dome shape inflated balloon. The method uses an airtight nylon reinforced sheet of synthetic rubber and it is anchored to previously prepared foundations. This sheet is overlaid with spiral steel mesh and a special concrete mix is poured over the entire assembly. After which a top sheet of synthetic rubber is placed over the poured concrete for stability and weather protection and so forms a sandwich construction.

Air is then pumped under this sandwich construction inflating and lifting it into the dome shape and when the concrete is firm and dry some thirty six hours later the internal sheet of synthetic rubber is deflated and removed and the exterior sheet removed.

A disadvantage of this construction is that such a building shell is only a single layer shell which lacks effective thermal insulation, and it is necessary after the construction has been formed to remove portions therefrom so as to insert windows, doors and other external openings. Another disadvantage of this construction is that in the main only a dome shaped construction can be formed by this method and this restricts the final shape of buildings which can be produced by the building method. If any window dormers are required they must be added afterwards at an additional cost.

Whilst the materials for building shells may be efficiently used, there have been relatively few thin shell building constructions utilised because of the high cost of establishing the required double curvature formwork, or the high cost of establishing the reinforcing cage for ferrocement, or the extra high cost of producing a variety of shapes such as flaring dormers.

Accordingly, an object of the present invention is to overcome at least in part the disadvantages stated above, and to provide an improved method of relatively inexpensively manufacturing and forming a constructional unit or shell in a variety of structural shapes and usable for a variety of different purposes.

It is another object of the present invention to provide a method of constructing a constructional shell for a building in which either no formwork or the minimum of formwork is required.

Further objects and advantages of the present invention will become apparent from the following descriptions which are given by way of example only.

According to the present invention there is provided a method of constructing a construction shell, the method comprising the steps of:

forming a sheet of thin flexible material into a shape complementary to the shape of a constructional shell to be formed; erecting and supporting the sheet material in the desired shape and configuration of shell required; strengthening and stiffening the sheet of thin material progressively to form a strengthened shell former of the desired shape; coating the strengthened and stiffened shell former with at least one layer of an outer or inner structural coating material so as to form a constructional shell of desired shape which can be used for a variety of different building constructions.

The method of constructing an outer shell for a building according to the invention as hereinbefore described can additionally comprise the following steps:

constructing a building foundation, foundation slab or wall of a desired shape; fixing peripheral edge parts of the sheet of material to the building foundation and erecting and supporting the sheet of material in a double curvature shape so that the sheet of thin material can be progressively stiffened and strengthened to form a stiffened shell former of the desired shape on which or inside of which a layer of structural coating material can be applied.

The method of forming the constructional shell of the present invention can be utilised in the constructing of an outer shell for a building wherein the shape of a double curvature outer shell is established from a previously flat stretched thin sheet be either inflation, propping or a combination thereof. The outer shell shape for the building can be established from the sheet of material (which can be of double membrane thickness) by preshaping, or by selected area stiffening of the material with cold hardening plastics materials and then changing the shape of the remaining areas by inflation, deflation or propping; and/or the material can be restrained in the required shape by ropes, wires or woven mesh.

The method of constructing an outer shell for a building in which the outer shell thereof can also include a progressive stiffening of a thin shaped stretched sheet or sheets by placing thereon or therewithin a cold hardening plastics material such as a rigid foamed plastics material or other materials which are light in weight per sheet surface area.

In the present invention the method of constructing the constructional shell can include the steps of fixing a sheet of elastic membrane to a foundation to form an air tight seal therebetween so that the elastic membrane can be subsequently inflated to form the double curvature shape, and when a dormer is required in the structure, the flat elastic sheet of material can be folded where the dormer is to be positioned so that it forms, when inflated, an additional portion which can be shaped as required.

Alternatively, to reduce the amount of stretch to form the required shape the flat elastic sheet of material can be draped over and folded at the base of pre-erected dormer formers so that when inflated the elastic sheet forms the required double curvature shape with dormer formations.

The thin sheet material can, for example, be a sheet of plastic material, polythene, rubber, butyl rubber, synthetic rubber or hypolon, or a mesh of hessian, polypropylene, nylon or glass fibre supported by an airtight sheet or any suitable material that can be supported by being inflated by air pressure so as to be tightly stretched, draped or propped to form a required shape. Any such temporary support included being readily removable.

Alternatively a frame can be used to support the sheet of material and in certain situations the frame can be left within the structure when completed if this is desired.

The shaped and formed sheet of material can be stiffened by placing thereon or therewithin progressive layers of a rapid setting rigid foamed plastics material, for example polyurethane foam, polyurethane foam embedding a reinforcement mesh or glass reinforced plastics material or any material which is light in weight so that there is formed a strengthened shell former upon which an outer or inner structural coating material can be placed. By embedding a reinforcement mesh or fibre in the stiffening layer or layers the initial sheet and stiffening reinforcement can be stretched by extra air pressure and therefore achieve better control of shape or enable a reduction in the stiffening material.

The structural coating material can for example, be a pneumatically applied or hand applied mortar or fibre reinforced concrete, or any structural coating that can be spray or hand applied such as ferro-cement, epoxy reinforced sand or, internally only, a fibre reinforced hard-walled gypsum.

Alternatively the shell can be sandwich type construction where a layer of fibre or wire reinforced concrete is placed on either side of the rigid foamed plastics material so as to sandwich same. This sandwich construction can consist of fibre reinforced gypsum on the inside of the shell and fibre reinforced concrete on the outside of the shell.

Other aspects of the present invention, which should be considered in all its novel aspects, will become apparent from the following descriptions which are given by way of example only of some embodiments of the present invention.

These embodiments of the present invention will now be described with reference to the accompanying diagrammatic drawings, in which:

FIG. 9 shows a cross-section through the shell of yet another alternative construction; and FIG. 10 shows a cross-section through the top of a window or door frame held in position during building of a building shell in accordance with the present invention.

Figure 1:
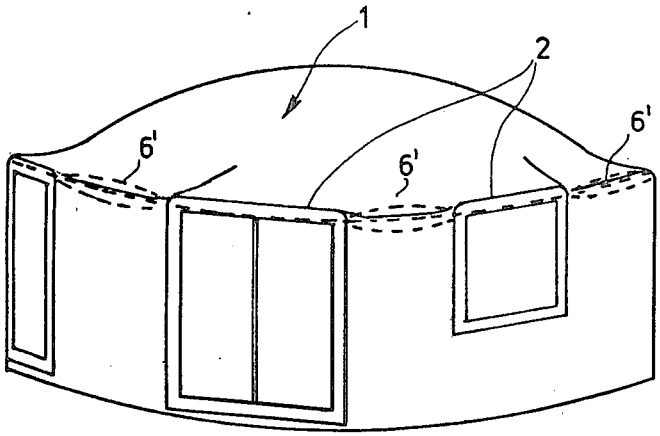
FIG. 1 is an example of a building shell formed according to one method of the present invention, which can be used as a residential dome shaped building with flaring dormers.

The present invention is preferably utilised for constructing a shell usable as an outer building shell which can be used for a number of different purposes. The outer building shell can have a double curvature shape, however it is to be appeciated that a variety of different structural shapes can be formed and are to be construed as included in the present invention.

Initially, after the shape and plan of the building have been decided upon a layer or combination of layers of sheet material, for example, a sheet or sheets of thin flexible material which can be a sheet constructed from a natural rubber, or a synthetic material or plastics, e.g. polystyrene or polyurethane; or a linen, hessian, woven fibre or woven wire or other flexible material is or are formed into a desired shape and supported with props, stretched wires and/or air pressure. The sheet of material is advantageously erected to the desired shape by being inflated and if necessary temporarily assisted in this regard by a very thin air tight membrane. Alternatively the sheet of material can be stretched or draped between a minimum number of beams or formwork if this is required.

The sheet of material or materials has progressive layers placed thereon or therewithin of any suitable material which imparts to the sheet material sufficient rigidity to later support a stronger structural shell. For example, the progressive strengthening can be provided by a layer or layers of a foamed plastics material for example, foamed polyurethane or polystyrene (which can include gypsum or cement for bondage), thin layers of fibre reinforced plastics material, gypsum or cement, or any material or combination of materials that provides progressive stiffening and strengthening to the sheet material in providing a shell former that can then be used to support a heavier and stronger structural shell during construction.

The structural/constructional shell can be a reinforced concrete shell which when constructed in accordance with the invention will have adequate strength in the stiffened shape and employ a minimum amount of materials and labour. The concrete shell can be fibre reinforced (utilising a fine woven mesh or loose fibre reinforcement which allows very thin concrete shells by eliminating the cover problems of traditional steel bar reinforcement and by greatly improved impact and crack resistance); pneumatically applied concrete or shotcrete concrete (which reduces the labour and gives improved bonding and compaction to the previous layer); in some situations hand trowelling of the concrete may be preferred.

The structural shell can be reinforced solely by, or combination of, wire, woven wire, wire fibers, glass fibres, polypropylene fibres, nylon fibres, wet asbestos fibres, carbon fibres, hemp fibres or a variety of polymer fibres to form a thin dense structural shell that can achieve its strength from the double curvature shape.

The structural shell of reinforced concrete, epoxy reinforced sand or (internally only for small shells) fibre reinforced gypsum; or fibre reinforced plastics (of advantage to reduce the weight of a section or unit), can be sprayed thereon or laid thereon or therewithin progressively so as to form a structural shell of the building construction.

An example of a formed dome shaped building shell (for such as a residential building) is shown in FIG. 1 of the accompanying drawings and is generally indicated by arrow 1. The building shell includes flaring dormers 2 which can be used to have placed therein doors or window openings.

Figure 2:
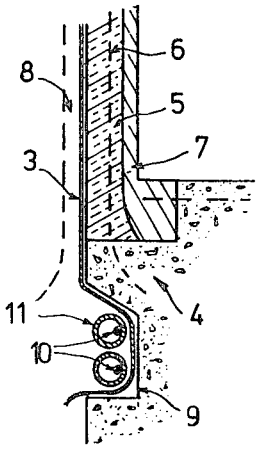
FIG. 2 is a cross-section through a portion of foundation showing the manner in which a sheet of thin material or membrane is fixed in position during the initial building of the shell.
Figure 3:
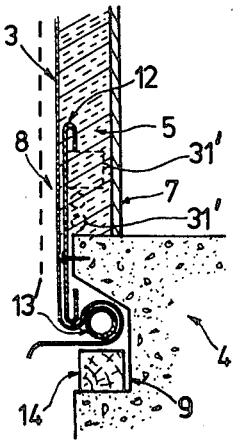
FIG. 3 is a cross-section through an alternative construction showing the manner in which the membrane can be fixed in position during the initial building of the shell.

Initially a foundation structure 4 (examples of which are shown in FIGS. 2 and 3) is built to the desired plan of the building and appropriate building services are incorporated therein, and the building shell 1 shown is formed over the foundation structure 4 by inflating an originally substantially flat elastic sheet of material, for example a sheet 3 of butyl rubber is provided with an airlock or airlocks and is inflated to allow access to the inflated shell 1 so that dormer props can then be placed into position.

After the elastic sheet 3 is inflated to a desired shape it is insulated and stiffened on either the inside or the outside thereof with a layer or layers of foamed plastics material 5 shown in FIGS. 2, 3, 4 and 5 to a required thickness. A mesh reinforcement 6' can be embedded in the plastics materials to strengthen same and enable increased air pressure to give improved support for the structural shell to be formed thereover. The foamed plastics material can be any foamed plastics material having inherent strength and rigidity when set, for example, sprayed rigid polyurethane or polyurethane sprayed on a woven reinforcement sheet.

The stiffened shell former then has an interior structural coating or surface applied thereon, for example, as shown in FIGS. 2, 3, 4 and 5, a fireproof fibre reinforced concrete or gypsum shell 7 is applied.

The sheet 3 can then be either peeled off and an exterior protective layer 8 applied, for example, a thin dense structural fibre reinforced concrete shell can be applied; or alternatively, the butyl rubber sheet 3 can remain and act as the outer protective sheet material or can be overlayed by an exterior shell of fibre reinforced concrete, or any other suitable material as a decorative exterior finish.

The example of foundation detail shown in FIG. 2 is a cross-section through a foundation of a circular plan and consists of a recess 9 in which the sheet 3 is friction fixed using a tensioned wire or wires 10 which can be contained in a hose pipe or hose pipes to prevent damage to the sheet 3 and thus enable reuse of the flat elastic sheet for any other floor plan or dormer arrangement.

The example of foundation detail shown in FIG. 3 is a cross-section through an alternative foundation where a recess 9 has an extension 12 fixed to the top corner thereof so that the sheet 3 is held in the recess 9 by a locking tube or strip 13 plus a packing strip 14 to avoid damage to the sheet 3. The extension 12 can protrude above the floor slab to enable the fixing of electrical services 31' and to give the polyurethane a larger surface to bond to during construction.

Figure 4:
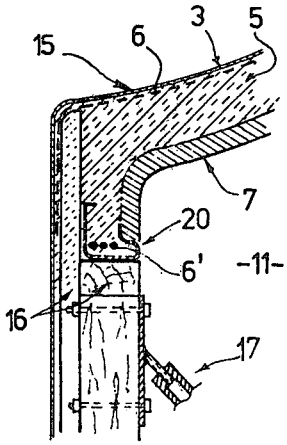
FIG. 4 is a cross-section through the top of a flaring dormer which can be incorporated into a building shell in accordance with the present invention.

The top of the flaring dormer generally indicated by arrow 15 in FIG. 4 is a cross-section therethrough showing the manner in which a temporary dormer shaping frame 16 is propped by a screw adjustable prop 17 into the membrane 3 from the inside of the building shell 11.

All temporary dormer shaping frames 16 to be propped when the sheet 3 is inflated are advantageously hinge fixed to the floor of the foundation and laid flat thereon to enable the sheet 3 to be placed thereover. The substantially flat sheet 3 can then be folded at each dormer position as considered necessary to minimise the amount of stretch during inflation and propping. The sheet 3 is inflated to just over prescribed dome or like-shape by a pumping mechanism so as to enable easy erection of dormer props 17 and then the sheet 3 is partly deflated to form the flaring dormer shapes and to reduce the centre of the elastic sheet to the prescribed roof height. During building and forming the centre height is held constant by a height control mechanism. The height control mechanism can include a cord that operates a butterfly valve to expell surplus air and can also activate the air pumps. A precautionary mechanism in the form of a pressure control valve is preferably included, particularly when spraying of material on the inside is to be carried out.

Figure 5:
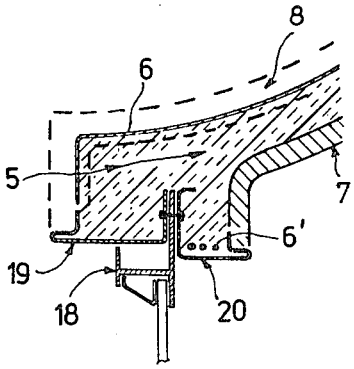
FIG. 5 is a cross-section through the top of a flaring dormer after the removal of the dormer prop and installation of a window frame plus dormer extension incorporated into a building shell in accordance with the present invention.

Details for fixing windows, doors and other openings and producing extended dormer shapes as shown in FIG. 5 are numerous and can consist of adding window frame 18 and extension sections 19 which are fixed to an internal trim section 20 which can be cast in with the foamed plastics stiffening material and fibre reinforced concrete or gypsum as shown in FIG. 4 and can support reinforcing wires 6' and reinforcing mesh 6.

The exposed part of the internal trim section 20 is closely fitted to the temporary dormer shaping frames to leave a clean face after spraying or plastering is completed on the inside and the temporary dormer shaping frames have been removed.

Alternatively the window and door frames can be embedded directly into the multilayer shell during stiffening whether the layers are applied on the inside or outside of the elastic sheet material. The flaring dormer extension can alternatively consist of a thin precast fibre reinforced concrete window or door frame that can be added to the flaring dormer shape and incorporated as part of the building shell.

In accordance with an alternative embodiment of the present invention not shown in the drawings two flat sheets of butyl rubber can be fixed to a simple foundation incorporating drainage channels and by controlled air pressure and a height control mechanism a housing shape can be established by inflation and propping arched windows and door frames against the inside surface. This shape can be progressively strengthened and stiffened by spraying rigid polyurethane foam and by pneumatically gunning fibre reinforced concrete to the entire inside surface including the floor. Because the butyl rubber membrane completely encloses the housing shell except for window and door openings, considerable savings in foundation and basement costs can be achieved by partly burying the uphill side on sloping sites.

In yet another alternative embodiment of the present invention a flat sheet of woven glass fibre, polypropylene, fibre or any other soft flexible woven sheet material can be laid over an airtight support flat sheet such as polythene or any other elastic sheet material. This combination of sheet materials can be draped over any suitably arranged floor plan, including a number of temporary internally propped dormer formers, and surplus material is folded within and under permanent dormer frames fixed or propped on the outside. The sheet material is fixed to the foundation to form an airtight seal and inflated to establish the required shape. The shape of building shown in FIG. 1 can be achieved by this method.

In accordance with present invention a stiffening layer consisting of a thin layer of gypsum slurry, or other suitable internal lining material is sprayed into the woven mesh. This thin reinforced gypsum shell hardens quickly enabling a rigid watertight polyurethane insulation foam to be sprayed over the gypsum and to encase and seal the perimeter of all dormer frames. Any surplus polyurethane is trimmed to the required shape and the external structural reinforced concrete shell is pneumatically applied. The concrete reinforcement can be placed as a woven mesh of fine wire, glass fibre, polypropylene fibre or any other woven fibre applied with the concrete.

When the structural shell has achieved sufficient strength the supporting air pressure is removed including the dormer props and polythene sheet to give a smooth internal reinforced gypsum surface. The initial stiffening with gypsum also has the advantage of protecting the stretched polythene from the heat generated by the polyurethane foam.

The detail for fixing the temporary internal air tight sheet material can consist of a plastic lipped channel section or other material that can easily be curved to the floor plan and be glued, nailed or embedded to the floor. The elastic sheet is pushed into the lipped channel, and held by a locking tube or strip plus a packing strip similar to the fixing mechanism shown in FIG. 3. When the elastic sheet is removed the recess can act as an electrical conduit and a cover skirting can be clip or screw fixed to give a protective cover. This elastic sheet fixing detail allows the elastic sheet, to remain undamaged and reusable.

In accordance with further alternative embodiment of the present invention not shown in the drawings a circular reservoir dome roof can be built over a very thin elastic flat membrane inflated to a dome roof shape. The sheet of thin elastic material, such as polythene is initially stiffened with a sprayed thin dense layer or layers of glass reinforced plastics material such as fibreglass on the top side thereof and when sufficiently stiff the supporting air pressure is increased stressing the fibreglass with little or no change in surface position. A thin layer of pneumatically applied reinforced concrete can then be placed thereon and when hardened followed by another layer of pneumatically applied shotcrete reinforced concrete to achieve the final design thickness. This method of constructing a concrete tank shell avoids the difficulty of removing traditional formwork and the plastic internal finish produces a protective coating particularly useful in a sewage tank situation.

Figure 6:
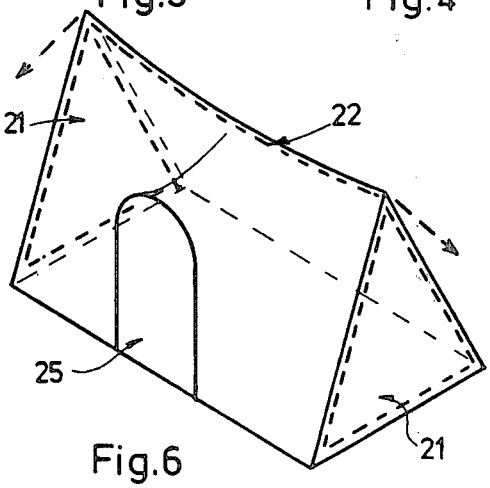
FIG. 6 shows an alternative example of building shell in accordance with the present invention.
Figure 7:
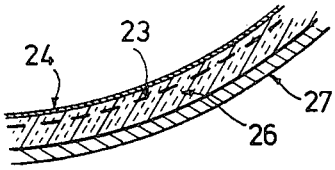
FIG. 7 shows a cross-section through the shell of an example of building in accordance with the present invention.

In yet another alternative embodiment of the present invention shown in FIGS. 6 and 7, an "A" frame house structure can be formed consisting of two permanent "A" frame end dormers 21 (shown dotted) connected by a draped apex cable 22 (shown dotted). The dormer frames 21 have a reinforcement mesh 23 and coloured hypalon sheet 24 draped therebetween. The reinforcement sheet 23 and hypalon sheet 24 are then stretched and shaped to form two pagoda side shells using two half height side dormers 25 only one of which can be seen on one side of the building shell.

This coloured hypalon stretched sheet membrane 26 is stiffened and insulated on the inside with rigid polyurethane foam 26 (FIG. 7). The reinforcement mesh 23 embedded in the foam can be further tensioned by tensioning the draped apex cable 22 to enable the application of a structural internal layer or layers of reinforced pneumatically applied concrete 27. The coloured hypalon membrane 26 can then remain as an exterior waterproof membrane if required.

Figure 8:
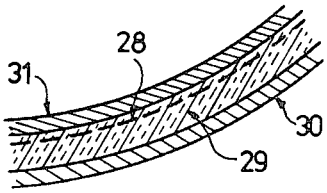
FIG. 8 shows a cross-section through an alternative shell construction in accordance with the present invention.

In the embodiment shown in FIG. 8 a hessian layer 28 is stretched to the shape required and sprayed progressively thereon are layers of polyurethane foam 29 which forms a progressively strong stiffening support upon which a layer of fibre reinforced concrete or gypsum 30 can be sprayed when the polyurethane is supported by air pressure. A reinforcing layer in the form of, for example, a wire mesh (not shown) can be included and this can support the hessian layer 28. The reinforcing being formed within the progressive stiffening or additional structural layer when this is included.

To complete the building construction still temporarily supported by air pressure a thin structural layer or layers reinforced concrete 31 is or are pneumatically applied thereon to form a sandwich type construction of a desired shape which can be a hyperbolic paraboloid or pagoda shape and this building construction can be used as required.

In the example shown in FIGS. 9 and 10 the building is formed by spraying to the outside of the flexible sheet 3 a layer of stiffening material 5. The shell former produced has a layer or layers 7 of a structural coating material applied thereto leaving the space within an exteriorally positioned frame 16A free of coating materials and stiffening material. The internal props 17 temporary dormer frame 16, and the sheet of flexible material 3 can be removed if desired.

In use the present invention provides for an inexpensive and simple building construction which can be manufactored in situ whenever required. The shape of the building construction is preferably of a double curvature shape for strength, however it is envisaged that other shapes can be constructed and the desired shape is formed by a sheet of thin stretched material on which progressive layers of strengthening material are placed to form a base for a structural material to be placed thereon or therein to enable any temporary supports including air pressure to be removed.

Thus by this invention there is provided a method of constructing buildings which is inexpensive and which enables a building to be built in situ with a minimum of formwork, materials and labour.

Particular forms of the invention have been described by way of example and it is envisaged that modifications to and variations of the invention can take place without departing from the scope of the appended claims.

What I do claim and desire to obtain by Letters Patent of the United States is:

1. A method of constructing a construction shell, the method comprising the steps of:

constructing a building foundation of a desired shape;

fixing a sheet of thin flat elastic material to the foundation to form a substantially airtight seal therebetween;

inflating the sheet of thin material to form a double curvature shape and the configuration of a shell on the foundation;

propping selected parts of the sheet of thin material with internally positioned formers which shape the sheet of material around window and door spaces;

positioning window and door frames externally of the sheet of material and in association with the internally positioned formers;

applying a strengthening and stiffening material to the outside of the sheet of thin flexible material progressively to form a strengthened shell former in which the areas within the externally positioned window or door frames are free from the strengthening and stiffening material; and applying a coating of at least one layer of structural coating material on the outside of the strengthened and stiffened shell former;

and removing the internally positioned formers whereby there is formed a constructional shell for a building of any desired shape which can be used for a variety of different building constructions.

2. A method of constructing a constructional shell as claimed in claim 1 wherein at least one layer of structural coating material is applied to the inside of the shell former with the sheet of thin flexible material remaining in place.

3. A method of constructing a constructional shell as claimed in claim 1 wherein after the layers of structural coating material are applied to the outside of the shell the sheet of thin material is removed and at least one layer of structural coating is applied to the inside of the shell former.

4. A method of constructing a constructional shell, the method comprising the step of:

constructing a building foundation of a desired shape;

fixing a sheet of thin flexible material to the foundation to form a substantially airtight seal therebetween;

inflating the sheet of thin flexible material to form a double curvature shape and the configuration of a shell on the foundation;

propping selected parts of the sheet of thin material with internally positioned formers which shape the sheet of material around window and door frames positioned therewith;

applying a strengthening and stiffening material to the inside of the sheet of thin flexible material progressively to form a strengthened shell former in which the areas within the window and door frames are free from the strengthening and stiffening material; and applying a coating of at least one layer of structural coating material on the inside of the strengthened and stiffened shell former whereby there is formed a constructional shell for a building of any desired shape which can be used for a variety of different building constructions.

5. A method of constructing a constructional shell as claimed in claim 4 wherein the layers of structural coating material are applied to the inside and then the outside of the shell former with the sheet of thin flexible material remaining in position.

6. A method of constructing a constructional shell as claimed in claim 4 wherein the sheet of thin material is removed after the application of the structural coating material and then a further layer of structural coating material is applied to the outside of the shell former.

7. A method of constructing a constructional shell as claimed in claim 4 wherein the strengthening and stiffening material is applied to the inside of the sheet of thin flexible material and then at least one layer of structural coating material is applied to the inside and outside of the shell former.

8. A method of constructing a constructional shell as claimed in claim 4 wherein the sheet of thin material is removed after the application of the strengthening and stiffening material before the structural coating material is applied to both the inside and outside of the shell former.

9. A method of constructing a constructional shell as claimed in claim 4 wherein the shape of the double curvature constructional shell is formed on the foundation by a previously flat elastic thin sheet of flexible material which is inflated and propped to form the shell.

10. A method of a constructional shell as claimed in claim 4 wherein the shape of the double curvature constructional shell is formed on the foundation by a previously flat elastic thin sheet of flexible material which is inflated, internally propped and then partly deflated to form the shape of the constructional shell.

11. A method of constructing a constructional shell as claimed in claim 4 comprising controlling the height of the double curvature shell on the foundation by automatically adjusting the height by controlling the amount of air expelled using a cord which operates a butterfly valve to maintain the height of the sheet material.

12. A method of constructing a constructional shell as claimed in claim 4 wherein the sheet of thin flexible material is elastic and substantially flat prior to inflation and the sheet when subsequently peeled off returns to its previous shape so that it can be reused to form another double curvature constructional shell.

13. A method of constructing a constructional shell as claimed in claim 4 wherein the strengthening and stiffening material applied to the double curvature shape and configuration of the shell on the foundation is a cold hardening plastic material which is rigid when set.

14. A method of constructing a constructional shell as claimed in claim 4 wherein the sheet of thin material is folded at the base of the internal formers with the fold adjacent the foundation so that when the sheet is subsequently inflated the fold forms an additional portion of the sheet of material above the foundation which is shaped as required to reduce the amount of stretch in the sheet of material around the internal frames.

15. A method of constructing a constructional shell as claimed in claim 4 wherein the window and door frames are pre-erected and the sheet of thin material is draped thereover with any surplus perimeter material folded at the base of the pre-erected window and door frames prior to inflation so that when subsequently the flexible material is inflated it forms the required double curvature shape.

16. A method of constructing a constructional shell as claimed in claim 4 wherein the shape of the double curvature shell on the foundation is established by pre-shaping the thin sheet of material and then inflating and propping to tension the sheet of thin material.

17. A method of constructing a constructional shell as claimed in claim 4 wherein the shape of the double curvature shell on the foundation is established by restraining parts of the thin sheet of material.

18. A method of constructing a constructional shell as claimed in claim 4 wherein the shape of the double curvature shell on the foundation is established by stiffening and strengthening selected areas of the thin sheet material and then changing the shape of the remainder of the double curvature shell by changing the inflating pressure and propping.

19. A method of constructing a constructional shell as claimed in claim 4 wherein the layer of strengthening and stiffening material is tension stressed by extra air pressure to achieve better control of the shape of the shell former while applying the structural coating material.

20. A method of constructing a constructional shell as claimed in claim 4 wherein the constructional shell formed is a sandwich construction formed with a thin structural layer of fiber reinforced material on either side of a rigid foamed plastic strengthening and stiffening material.

21. A method of constructing a constructional shell as claimed in claim 4 wherein the thin sheet of material is a sheet of material selected from the group consisting of plastics material, polyethylene, rubber, synthetic rubber, butyl rubber and hypalon.

22. A method of constructing a constructional shell, the method comprising the steps of:

constructing a building foundation of a desired shape;

erecting and supporting a sheet of thin flexible material to form the configuration of a shell on the foundation;

propping selected parts to tension the sheet of thin material with internally positioned formers which shape the sheet of material around window and door frames positioned therein and which form window and door spaces and protruding shapes which have the window and door frames associated therewith;

applying a strengthening and stiffening material to the sheet of thin flexible material progressively to form a strengthened shell former in which the areas within the window and door frames are free from the strengthening material; and coating the strengthened and stiffened shell former with at least one layer of a structural coating material, so as to form a constructional shell for a building of any desired shape which can be used for a variety of different building constructions.

23. A method of constructing a constructional shell as claimed in claim 22 wherein the shell former is coated with the coating material on the surface of the shell former opposite to the surface with the covering of flexible material.

24. A method of constructing a constructional shell as claimed in claim 22 wherein the shell former is coated with the coating material on both the surface not covered by the flexible material and on the thin sheet of flexible material.

25. A method of constructing a constructional shell as claimed in claim 22 wherein the shell former is coated with the coating material on the free surface of the shell former and the sheet of thin flexible material is removed from the strengthened shell former and the other surface of the shell former is coated with at least one layer of a structural coating material.

26. A method of constructing a constructional shell as claimed in claim 22 wherein the shape of the double curvature shell on the foundation is established by pre-shaping selected areas of the thin sheet of material and then changing the shape of the remaining areas upon inflation.

27. A method of constructing a constructional shell as claimed in claim 26 wherein the shape of the remaining areas is changed by propping the inflated shell.

28. A method of constructing a constructional shell as claimed in claim 27 wherein the pre-shaping of the selected areas comprises stiffening said areas with a cold hardening plastic material.

29. A method of constructing a constructional shell as claimed in claim 22 comprising peeling the sheet of thin flexible material off the shell for reuse to form another constructional shell.

30. A method of constructing a constructional shell as claimed in claim 22 wherein the strengthening stiffening material applied to the double curvature shape and configuration of shell on the foundation is a cold hardening plastic material.

31. A method of constructing a constructional shell as claimed in claim 22 wherein the sheet of thin material is folded at the base of the internal frame with the fold adjacent the foundation so that when the sheet is subsequently propped the fold forms an additional portion of the sheet material above the foundation which can be shaped as required in order to reduce the amount of stretch in the sheet of material around the internal frame.

32. A method of constructing a constructional shell as claimed in claim 22 wherein the window and door frames are pre-erected and the sheet of thin material is draped there-over with any surplus perimeter material folded at the base of the pre-erected window and door frames so that when subsequently the flexible material is tensioned it forms the required double curvature shape with dormer formations.

33. A method of constructing a constructional shell as claimed in claim 22 wherein the constructional shell is formed in a sandwich construction with a coating of a thin structural reinforcing material on either side of a rigid foamed plastic strengthening and stiffening material.

* * * * *